US006233850B1

(12) United States Patent
Peabody

(10) Patent No.: US 6,233,850 B1
(45) Date of Patent: May 22, 2001

(54) CLEAT FOR ATHLETIC SHOES

(76) Inventor: Steven R. Peabody, 320 W. Ash P.O. Box 207, Zionsville, IN (US) 46077

( * ) Notice: Subject to any disclaimer, the term of this patent is extended or adjusted under 35 U.S.C. 154(b) by 0 days.

(21) Appl. No.: 09/596,908

(22) Filed: Jun. 19, 2000

(51) Int. Cl.[7] ..... A43B 5/00; A43C 15/00
(52) U.S. Cl. ..... 36/134; 36/67 D; 36/127
(58) Field of Search ..... 36/67 D, 134, 36/127, 67 R, 67 A, 67 B, 59 A, 59 C

(56) References Cited

U.S. PATENT DOCUMENTS

| | | | | |
|---|---|---|---|---|
| 4,014,114 | * | 3/1977 | Jordan et al. | 36/67 D |
| 5,029,405 | * | 7/1991 | DeHaitre | 36/134 |
| 5,794,367 | * | 8/1998 | Carroll | 36/134 |
| 6,023,860 | * | 2/2000 | McMullin | 36/127 |
| 6,041,526 | * | 3/2000 | Collins | 36/127 |
| 6,052,923 | * | 4/2000 | McMullin | 36/127 |

* cited by examiner

*Primary Examiner*—M. D. Patterson
(74) *Attorney, Agent, or Firm*—Richard L. Huff

(57) ABSTRACT

A cleat for athletic shoes which provides a sole attachment member; a hub having a planar upper portion for contacting the shoe sole, a rounded lower portion for bearing weight of the user, and an edge; and resilient traction elements. The resilient elements are made up of an outward band extending from the periphery of the upper portion of the hub, an inner band extending from the periphery of the lower portion of the hub, a bottom band, a top band, and a space bordered by the outer band, the inner band, the bottom band and the top band. When the user is walking on soft surfaces, the traction elements provide traction and the lower portion of the hub does not bear weight. When the user is walking on hard surfaces, the resilient traction elements bend outwardly allowing the hub to contact the walking surface and bear weight. This allows for longer life of the traction elements as well as uniform contact.

5 Claims, 3 Drawing Sheets

CLEAT FOR ATHLETIC SHOES

BACKGROUND OF THE INVENTION

1. Field of the invention

This invention deals with non-metallic cleats for athletic shoes, which cleats provide traction on grass surfaces and provide resistance to wear when used on hard walking surfaces.

2. Description of the related art

It has long been known that metallic cleats on athletic shoes, especially golf shoes, are harmful to the grass surfaces or floors on which they are used and fail to provide traction when worn on hard surfaces. To avoid this problem, a number of plastic golf cleats have been developed. One example of such a golf cleat is that shown in U.S. Pat. No. 6,009,640 to Deacon et al. Such plastic cleats routinely contain a threaded stud for securing the cleat to the sole of a shoe and a main cleat body which contains a convex lower surface containing a plurality of traction ribs. As these cleats are worn on both hard and soft walking surfaces, the hard surfaces have a tendency to wear down the traction ribs of the cleats, making replacement necessary more often than desired. U.S. Pat. No. 6,023,860 to McMullin discloses an athletic shoe cleat which does not adversely affect the turf while providing necessary traction. This cleat contains a hub having an outer flange, an upper surface of the hub containing an attachment stud, and a plurality of traction elements extending substantially laterally from the hub. When used on a turf walking surface, the traction elements extend downwardly to provide traction. When used on a hard surface, the traction elements bend outwardly so that the turf-engaging portions of the traction elements are protected from abrasion and wear. Since the traction elements still bear the full weight of the user, wear of these elements is inevitable. U.S. Pat. No, 6,052,923 to McMullin addresses the problem of wear of the traction element. The cleat of this patent contains an attachment stud, a flange, a plurality of relatively small traction protrusions extending from the flange, and a convex bearing portion extending downwardly from the flange. The small protrusions provide traction while the bearing portion bears the user's weight at all times, on both turf surfaces and hard surfaces. On soft surfaces, the traction protrusions sink into the surface sufficiently to provide traction and to cause the bearing portion to bear weight. On hard surfaces, the resiliency of the traction protrusions causes them to bend so that full weight of the user is carried by bearing portion.

SUMMARY OF THE INVENTION

The present invention provides a cleat similar to that disclosed in U.S. Pat. No. 6,052,923 with the improvements being that the traction elements of the present invention are longer for increased traction and exhibit increased resiliency.

The present invention provides a removable cleat for use with an athletic shoe. The cleat provides traction on soft walking surfaces and reduces wear of the traction elements when used on hard surfaces.

The athletic shoe on which the cleat is used has a sole, and the sole has a plurality of sole attachment means for attachment of the removable cleats. The removable cleat has a sole attachment member having a longitudinal axis for mounting the cleat in the sole attachment means of the shoe. The cleat has a hub having a planar upper portion which is perpendicular to the sole attachment member having a first periphery and a rounded lower portion having a second periphery.

Each cleat has a plurality of resilient, cantilevered traction elements extending radially outwardly and downwardly from the hub. The traction elements have an outward band extending downwardly and outwardly from the periphery of the first portion of the hub, an inward band extending outwardly and downwardly from the periphery of the lower portion of the hub, a bottom band connecting the lower ends of the inner band and the outer band, and an upper band connecting the upper ends of the inner and outer bands. These bands surround an open space. This open space gives the traction elements greater resiliency while maintaining the ability to impart the required traction.

DESCRIPTION OF THE PREFERRED EMBODIMENTS

Figure 1:
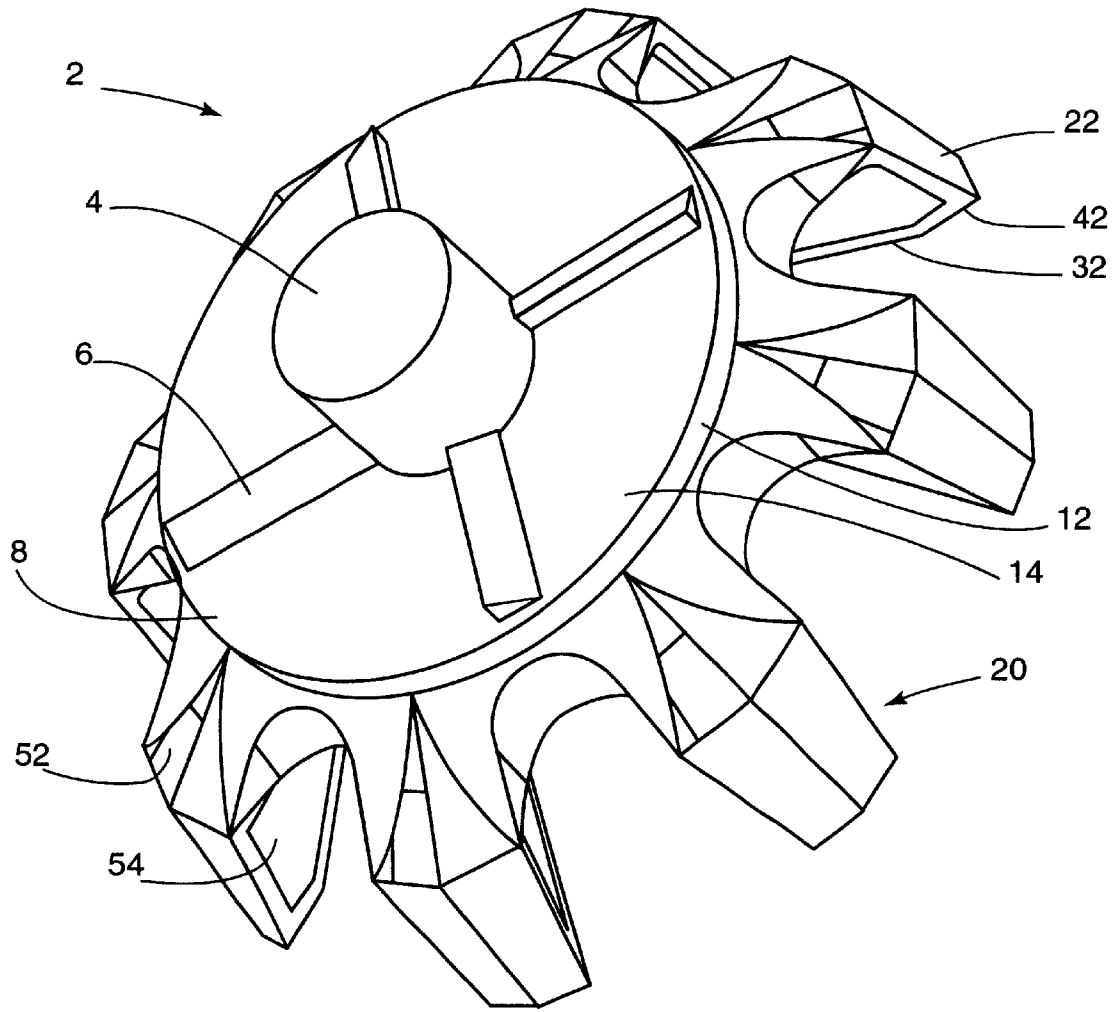
FIG. 1 is an elevational perspective view of a cleat of the present invention.
Figure 2:
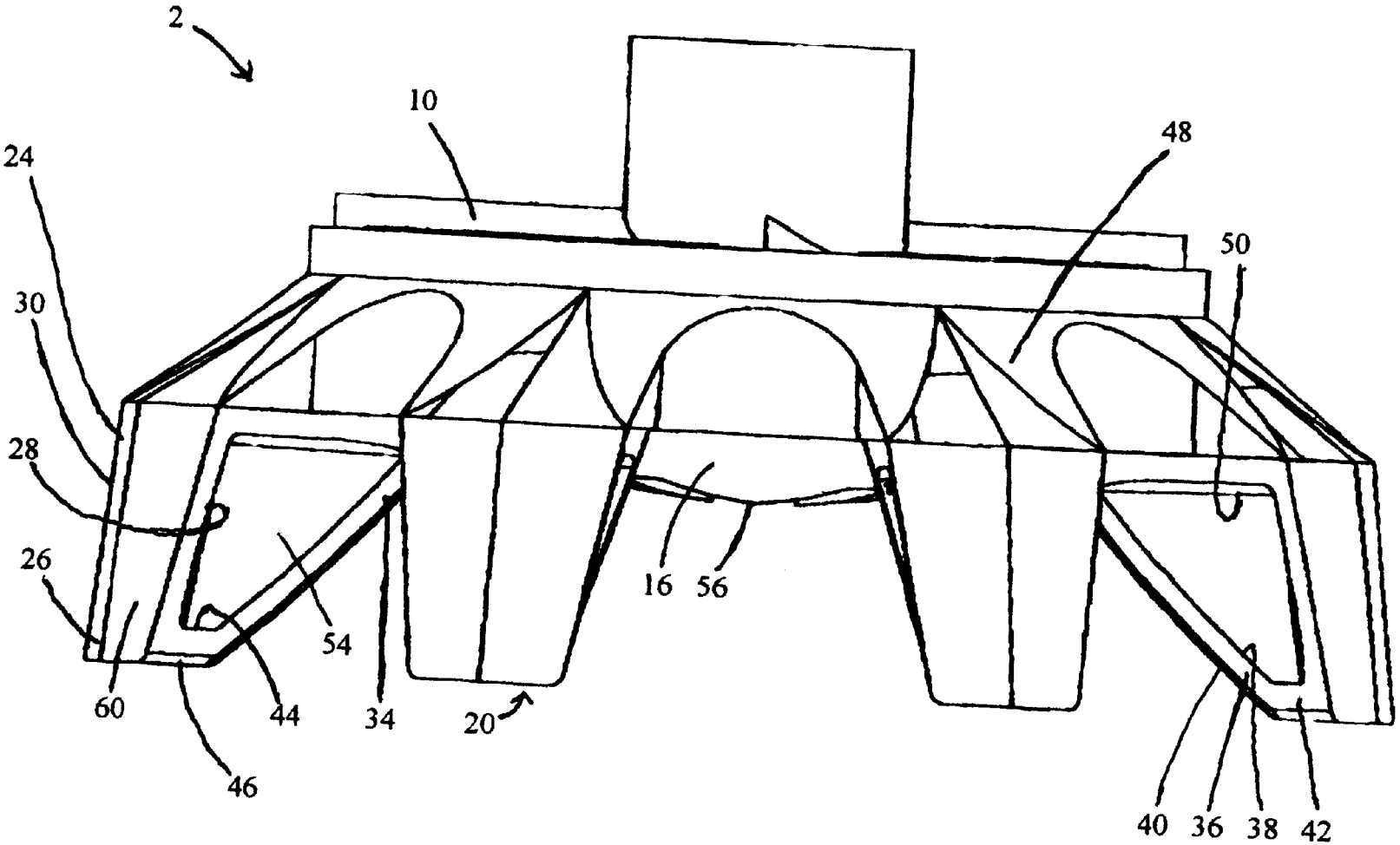
FIG. 2 is a side view of a cleat of this invention.
Figure 3:
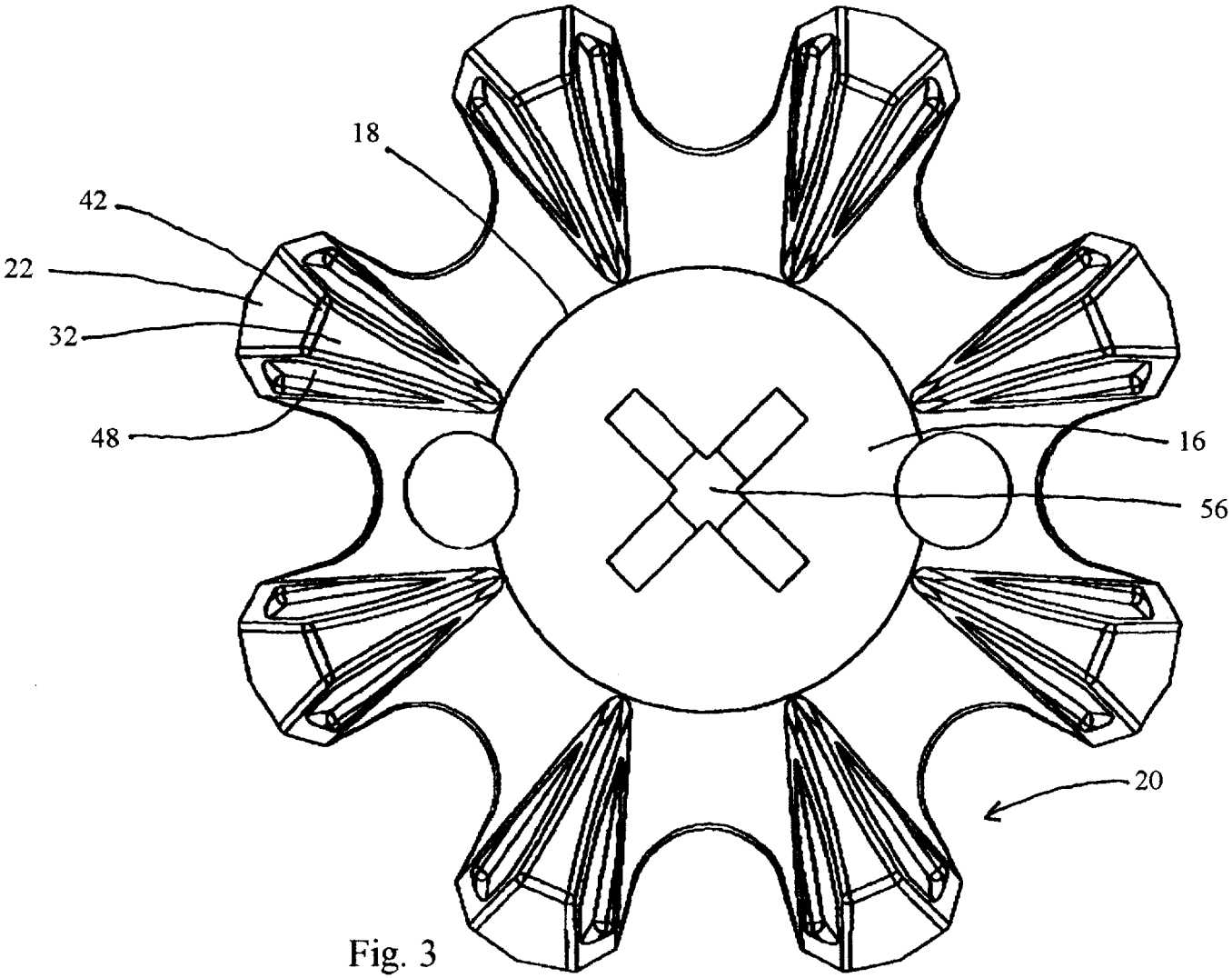
FIG. 3 is a bottom view of a cleat of this invention.

The preferred embodiments will now be described with reference to the above drawings wherein like reference characters refer to like features throughout.

The present invention provides cleats 2 for athletic shoes, especially golf shoes. The cleats 2 have a sole attachment member 4 having a longitudinal axis for fitting into sole attachment means in the soles of the shoes. Attachment to the shoe soles may be by any conventional means, such as threads or the illustrated breaking-lock system 6.

Adjoining the sole attachment member 4 is a hub 8. The hub 8 has a planar upper portion 10 perpendicular to the sole attachment member 4. This upper portion 10 is preferably circular in shape and contains a periphery 12. This portion 10 has an upper surface 14 which fits snugly against the sole of the shoe. The hub 8 contains a rounded, dome-shaped, lower portion 16 which is also preferably circular in shape, having a periphery 18.

A plurality (two or more, preferably eight) of resilient, cantilevered traction elements 20 extend radially outwardly and downwardly from the hub 8.

At least some of the traction elements 20 contain an outward band 22 having an upper end 24, a lower end 26, an inner surface 28, and an outer surface 30. The outward band 22 extends downwardly and outwardly from the junction of the outward band 22 with the top band 48.

These traction elements 20 contain an inward band 32 having an upper end 34, a lower end 36, an inner surface 38 and an outer surface 40. This band 32 extends downwardly and outwardly from the periphery 18 of the lower portion 16 of the hub 8.

There is a bottom band 42 extending from the lower end 36 of the inward band 32 to the lower end 26 of the outward band 22. This band 42 has an inner surface 44 and an outer surface 46.

There is a top band 48 extending from the upper end 34 of the outward band 22 to the periphery 12 of the hub 8. This band 48 has an inner surface 50 and an outer surface 52.

There is an open space 54 in each traction element 20 bounded by the outward band 22, the inward band 32, the bottom band 42, and the top band 48. Because the central portion of each traction element 20 is made up of empty space 54 rather than solid matter, the traction element 20 is highly resilient.

When the user is walking on a soft surface, such as turf, the outer surface 46 of the bottom band 42 makes contact with the walking surface. The bottom point 56 of the rounded lower portion 16 of the hub 8 is sufficiently higher than the bottom surface 46 of the traction elements 20 so that the lower portion 16 of the hub 8 does not make contact with the walking surface and does not bear the weight of the user. In this condition, the traction elements 20 are sufficiently firm to supply sufficient traction to the user. At the same time, the traction elements 20 are sufficiently soft as to avoid undue injury to the turf. Additionally, the configuration of the lower portion 16 of the hub 8 and the traction elements 20 is such that the lower portion 16 of the hub 8 prevents the areas between the traction elements 20 from filling with traction-reducing clumps of sod.

When the user is walking on a hard surface, such as a wood floor or a paved area, the traction elements 20 are readily pushed outwardly and the outer surface 40 of the inward band 32 makes contact with the hard surface. Due to the empty space 54 behind the inward band 32, there is reduced abrasion and wearing down of the traction element 20. Also, when the user is walking on a hard surface, the bottom point 56 of the rounded lower portion 16 of the hub 8 makes contact with the surface and bears the weight of the user.

The cleat 2 of the present invention is preferably manufactured by injection molding of non-metallic, polymeric material such as rubber, polyurethane, or polypropylene. When made of a single material, the preferred polymer is polyurethane. The cleat 2 may be manufactured using a two-step injection molding process, such as that described in my co-pending application, U.S. Ser. No. 09/468,689. When two polymeric materials are used, it is preferred that the hub portion 8, or at least the lower portion 16 of the hub 8, be made of wear-resistant, reinforced polymeric material. An example of such material is Nylon reinforced with arimid. In this event, the remainder of the cleat 2 is prepared from a rubber, polyurethane, or polypropylene polymer.

The configuration of the traction element 20 is not critical as long as it contains the empty space 54 surrounded by the bands 22 32 42 48. Regardless of the configuration, the upper portion of the traction element 20 should have greater dimensions than the lower portion. Thus, the cross-section of the traction element 20 may be a circle, semicircle, square, rectangle trapezoid, or preferably an irregularly shaped prism.

It is important that the traction elements 20 bend outwardly when in contact with a hard surface so that the rounded lower portion 16 of the hub 8 is free to contact the hard surface. Therefore, it is essential that the traction elements 20 extend downwardly and outwardly from the hub 8 as opposed to just downwardly or downwardly and inwardly. It is preferred that the bottom band 42 of the traction element 20 be parallel to the walking surface. There will be an obtuse angle formed at the juncture of the bottom band 42 and the inward band 32. It is preferable that the outer part of this angle be curved so that the transition between conditions wherein the traction element 20 is supporting the weight of the user and wherein the traction element 20 is bent outwardly is gradual and continuous rather than sharp.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A cleat for an athletic shoe, which cleat comprises a) a sole attachment member having a longitudinal axis for mounting the cleat to the shoe;

b) a hub having a planar upper portion perpendicular to the attachment member having a first periphery and a rounded lower portion having a second periphery; and c) a plurality of resilient, cantilevered traction elements extending radially outwardly and downwardly from the hub, wherein at least some of the traction elements have:

i) an outward band having an upper end and a lower end extending downwardly and outwardly from the periphery of the upper portion of the hub, ii) an inward band having an upper end and a lower end extending downwardly and outwardly from the periphery of the lower portion of the hub, iii) a bottom band connecting the lower ends of the outward band and the inward band, and iv) a top band connecting the upper ends of the outward band and the inward band, wherein the traction elements have open spaces bounded by the outward band, the inward band, the bottom band, and the top band such that when the user is walking on a soft surface, the lower portion of the hub does not contact the walking surface and does not bear weight and the bottom bands of the traction elements contact the walking surface and when the user is walking on a hard surface, the lower portion of the hub contacts the walking surface and bears weight and the traction elements bend outwardly so that the inward band contacts the walking surface.

2. The cleat of claim 1, wherein the cleat is molded from a polymeric material.

3. The cleat of claim 1, wherein the rounded lower portion of the hub is molded from a wear-resistant, reinforced polymeric material.

4. The cleat of claim 1, wherein the traction elements have a cross-section with the shape of an irregularly shaped prism.

5. The cleat of claim 1, wherein there are eight traction elements.

* * * * *